US010934629B2

(12) United States Patent
Yoshimura et al.

(10) Patent No.: US 10,934,629 B2
(45) Date of Patent: Mar. 2, 2021

(54) SURFACE-TREATED STEEL SHEET, ORGANIC RESIN COATED METAL CONTAINER, AND METHOD FOR PRODUCING SURFACE-TREATED STEEL SHEET

(71) Applicants: TOYO KOHAN CO., LTD., Tokyo (JP); Toyo Seikan Group Holdings, Ltd., Shinagawa-Ku (JP)

(72) Inventors: Kunihiro Yoshimura, Yamaguchi (JP); Naomi Taguchi, Yamaguchi (JP); Satoko Fukutomi, Yamaguchi (JP); Wataru Kurokawa, Kanagawa (JP); Munemitsu Hirotsu, Kanagawa (JP); Mitsuhide Aihara, Kanagawa (JP); Satoshi Mikami, Kanagawa (JP)

(73) Assignee: TOYO KOHAN CO., LTD., Tokyo (JP)

( * ) Notice: Subject to any disclaimer, the term of this patent is extended or adjusted under 35 U.S.C. 154(b) by 0 days.

(21) Appl. No.: 15/678,884

(22) Filed: Aug. 16, 2017

(65) Prior Publication Data

US 2017/0342584 A1 Nov. 30, 2017

Related U.S. Application Data

(62) Division of application No. 15/025,238, filed as application No. PCT/JP2014/070500 on Aug. 4, 2014, now abandoned.

(30) Foreign Application Priority Data

Sep. 25, 2013 (JP) ..... JP2013-197714

(51) Int. Cl.

| | |
|---|---|
| ***C25D 7/00*** | (2006.01) |
| ***C25D 9/10*** | (2006.01) |
| ***C25D 3/54*** | (2006.01) |
| ***C25D 21/12*** | (2006.01) |

(52) U.S. Cl.

CPC ..... *C25D 7/00* (2013.01); *C25D 3/54* (2013.01); *C25D 9/10* (2013.01); *C25D 21/12* (2013.01)

(58) Field of Classification Search

CPC .... C25D 9/10; C23C 22/361; C23C 22/34–38
See application file for complete search history.

(56) References Cited

U.S. PATENT DOCUMENTS

| | | | | |
|---|---|---|---|---|
| 2003/0145909 | A1* | 8/2003 | Diaddario, Jr. | C23C 22/34 148/267 |
| 2004/0144451 | A1* | 7/2004 | Matsukawa | C23C 22/34 148/247 |
| 2004/0244874 | A1 | 12/2004 | Nakayama et al. | |
| 2004/0244875 | A1 | 12/2004 | Yasuda et al. | |
| 2005/0175798 | A1* | 8/2005 | Kurokawa | C09D 5/28 428/34.1 |
| 2005/0177834 | A1 | 8/2005 | Campbell et al. | |
| 2006/0134327 | A1* | 6/2006 | Makino | B05D 7/14 427/180 |
| 2006/0185769 | A1 | 8/2006 | Nakayama et al. | |
| 2010/0230288 | A1 | 9/2010 | Kurokawa et al. | |
| 2013/0034745 | A1* | 2/2013 | Tachiki | B32B 15/015 428/679 |
| 2013/0202800 | A1* | 8/2013 | Brouwer | C23C 22/34 427/327 |
| 2013/0206285 | A1 | 8/2013 | Suzuki et al. | |

FOREIGN PATENT DOCUMENTS

| | | | | |
|---|---|---|---|---|
| CN | 102803561 | A | 11/2012 | |
| EP | 1566467 | A1 | 8/2005 | |
| JP | S54-68733 | A * | 6/1979 | C23F 7/12 |
| JP | 07-11483 | | 1/1995 | |
| JP | 2004-190121 | | 7/2004 | |
| JP | 2005-097712 | | 4/2005 | |
| JP | 2006-348360 | | 12/2006 | |
| JP | 2010-013728 | | 1/2010 | |
| JP | 2011-127141 | | 6/2011 | |
| JP | 2012-062518 | | 3/2012 | |
| WO | WO-2011098322 | A1 * | 8/2011 | C23C 22/73 |
| WO | WO2012/036200 | A1 | 3/2012 | |
| WO | WO02/103080 | A1 | 12/2012 | |

OTHER PUBLICATIONS

Nihon Parkerizing Co. Ltd., Derwent abstract and machine translation, JP S54-68733 A (Year: 1979).*
Nihon Parkerizing Co. Ltd., partial human translation, JP S54-68733 A (Year: 1979).*
European Search Report dated Jun. 21, 2017 in corresponding EP Application No. 14846940.6, 16 pages.
"Technical History of the Surface Treated Steel Sheet for Can in Japan," The Iron and Steel Institute of Japan, Oct. 31, 1998, pp. 87-90.
European Office Action dated Apr. 18, 2018, cited in corresponding application No. 14 846 940.6, 13 pages.
Office Action dated Nov. 6, 2017 CN Application No. 201480053046.8.

* cited by examiner

*Primary Examiner* — Brian W Cohen
*Assistant Examiner* — Ho-Sung Chung
(74) *Attorney, Agent, or Firm* — Muncy, Geissler, Olds & Lowe, P.C.

(57) ABSTRACT

Provided is a surface-treated steel sheet with a compound layer containing F and composed essentially or Zr at least on one surface thereof, wherein the Zr amount is 80 to 350 mg/m$^2$ and the F amount is 0.5 to 10 mg/m$^2$ within the layer, and an organic resin coated metal container manufactured using the surface-treated steel sheet. The surface-treated steel sheet of the present invention is manufactured through forming a layer having the Zr amount of 80 to 350 mg/m$^2$ at least on one surface of a steel sheet by cathode electrolytic treatment in an aqueous solution containing a Zr ion and F ion, and subsequently adjusting the surface to control the F amount to 0.5 to 10 mg/m$^2$ by one or more treatments selected from immersion and spraying with an ion-containing aqueous solution and cathode electrolytic treatment in the ion-containing aqueous solution.

7 Claims, No Drawings

SURFACE-TREATED STEEL SHEET, ORGANIC RESIN COATED METAL CONTAINER, AND METHOD FOR PRODUCING SURFACE-TREATED STEEL SHEET

CROSS REFERENCE TO RELATED APPLICATIONS

This application is a Divisional of co-pending application Ser. No. 15/025,238, filed on Mar. 25, 2016, for which priority is claimed under 35 U.S.C. § 120; which is a U.S. National Stage of International Application No. PCT/JP2014/070500 filed on Aug. 4, 2014, for which priority is claimed under 35 U. S.C. § 120; and this application claims priority of Application No. 2013-197714 filed on Sep. 25, 2013 in Japan under 35 U.S.C. § 119, the entire contents of all of which are hereby incorporated by reference.

BACKGROUND OF THE INVENTION

1. Technical Field of the Invention

The present invention relates to a surface-treated steel sheet, an organic resin coated metal container, and a method for producing the surface-treated steel sheet.

2. Description of the Related Art

In the fields of home electric appliances, building materials, vehicles, aircrafts, and containers, etc., chromate treatment is conventionally known as the treatment to improve adhesiveness between a steel sheet and organic coating. For its excellent corrosion resistance and adhesiveness, the chromate treatment has been widely used. There are two types to the chromate treatment: the first type includes hexavalent chromium within a layer and the second type does not include hexavalent chromium. In recent years, from the viewpoints of environment and occupational health, there is a growing trend to prohibit inclusion of hexavalent chromium even in starting materials themselves regardless of the state of the final product if the starting materials use.

For materials of metal containers such as cans and can lids, needless to say, the second chromate treatment type where hexavalent chromium does not remain in final products is used. Generally, coating of organic resin, etc., is further performed thereto. For example, a tin-plated steel sheet for which a cathode electrolytic treatment is performed in an aqueous solution of dichromate sodium, a steel sheet for which a cathode electrolytic treatment is performed in a fluoride-containing anhydrous chromic acid aqueous solution, or an aluminum alloy for which chromium phosphate treatment is performed, which is further coated with an organic resin is used.

Metal containers such as cans and can lids are often subjected to hot water retort treatment for the purpose of sterilization of their contents. For this reason, the materials are exposed to severe environments and thus there is a problem that adhesion between an organic resin coating and metal surface may deteriorate easily. In the past, many studies have been made to solve the problem. Currently, for a tin plate and electrolytic chromic acid treated steel sheet or the like used as the material for cans, with an aim of improving adhesiveness in hot water, a technique of making a metal surface excellent in adhesiveness to an organic coating by performing warm water washing or hot water washing in the last step of surface treatment to control elution of anions such as sulfate ions and fluorine ions within the treating coating is used (Non-patent Document 1: *History of coated steel sheets for cans in Japan*, published by The Iron and Steel Institute of Japan, issued on Oct. 31, 1998, last line in p. 87 to p. 90, and Patent Document 5: Japanese Patent Application Publication No. 1995-11483).

In recent years, as a non-chromium type surface treatment which has been studied for its application on steel sheet materials, there has been proposed an immersion treatment using a processing liquid containing Zr (zirconium) or Ti (titanium) (Patent Document 1: International Publication No. WO 2002/103080). However, a surface-treated steel sheet prepared by Zr or Ti immersion treatment is insufficient in its coating corrosion resistance. Further, because its layer deposition speed is slow compared to an electrolytic chromic acid treated steel sheet (TFS) which has been conventionally used as a material for cans, there is a problem of significant deterioration in productivity. For these reasons, as a high-speed treatment process to take over immersion treatment, there have been proposed Zr and/or Ti treatment and/or Al treatment by applying cathode electrolytic treatment. Each of these treatments is known for its high speed for generating a metal-oxygen compound on a base material surface (Patent Documents 2: Japanese Patent Application Publication No.2004-190121, Patent Documents 3: Japanese Patent Application Publication No. 2005-97712, and Patent Documents 4: Japanese Patent Application Publication No. 2006-348360).

Moreover, as a method to improve adhesiveness of a metal-oxygen compound layer to an organic resin layer, there has been disclosed a technique related to a manufacturing method of a steel sheet for containers with a chemical conversion layer, where the Zr metal amount is from 1 to 100 $mg/m^2$ and the F amount is 0.1 $mg/m^2$ or less, by forming a metal-oxygen compound layer containing oxygen compounds of Zr on a base material and then washing the surface of the metal-oxygen compound layer with hot water of 80° C. or more (Patent Document 6: International Publication No. WO 2012/036200).

SUMMARY OF THE INVENTION

When an objective is to improve corrosion resistance of a base material by generating a metal-oxygen compound layer of which the main constituent is a metal-oxygen compound of metal, such as Zr, Al and Ti directly onto the metal-base-material surface without preparing a metal-plated layer, the thickness of the coating (coating amount) should be made larger compared to a case where metal-plated layer is generated. Particularly, in an application to seamless cans to which intense processing is performed, the metal of the base layer may easily be exposed by processing or adhesiveness to an organic resin may easily be lowered. For these reasons, it has been demanded to secure corrosion resistance by increasing the coating amount, and at the same time, to improve adhesiveness to the organic resin.

In addition to the above aspects related to adhesiveness, there is another problem to be solved with the present invention, that is, to prevent elution of constituents of a metal container to its content. It is very important for the metal container to maintain the quality of its content and special attention should be paid to the elution of constituents of the metal container to its content. In general, typical examples of elution are elution of metal by corrosion and elution of anions such as a sulfate ion and a fluorine ion in the layer. Therefore, attention should be paid not only to the pH and sterilization conditions of the content, but also to many things such as the coating amount and shape of the surface in the metal surface treatment, and adhesiveness to an organic resin coating such as a film or coating film.

In Patent Document 5, an example of improvement in adhesiveness by washing the surface of the metal-oxygen compound layer on the metal-plated layer with hot water is disclosed. However, when a large coating amount as above is required, we have found that washing of the electrolytic chromic acid treated steel sheet, which is conventionally used, is insufficient in order to achieve the target surface treatment characteristics and suppression of elution. Furthermore, we have also found that when diverting a conventional electrolytic chromic acid treatment line, because washing that is even longer than the conventional washing is required, there are many problems such as productivity load and energy-use load, etc., in other words, restriction in an operation speed of the surface treatment line, increase in the number of treatment tanks for washing, and use of a large volume of hot water, etc.

The present invention is made in view of the above problems, and an object is to provide a surface-treated steel sheet having excellent adhesiveness to an organic resin layer and corrosion resistance when an organic resin layer is formed on its surface, an organic resin coated container having excellent adhesiveness to an organic resin and resistance to fluorine elution, and a method for producing the surface-treated steel sheet.

Means for Solving Problems

According to the present invention, a surface-treated steel sheet with a compound layer containing F and composed essentially of Zr at least on one surface of the steel sheet, wherein the Zr amount is 80 to 350 mg/m$^2$ and the F amount is 0.5 to 10 mg/m$^2$ within the layer is provided.

Further, according to the present invention, an organic resin coated metal container manufactured using the surface-treated steel sheet is provided.

Furthermore, according to the present invention, a method for producing the surface-treated steel sheet for forming a compound layer containing F and composed essentially of Zr at least on one surface of the steel sheet, including forming a layer where the Zr amount within the layer is 80 to 350 mg/m$^2$ by performing a cathode electrolytic treatment to the steel sheet in an aqueous solution containing a Zr ion and F ion, and subsequently adjusting the surface to control the F amount within the layer to 0.5 to 10 mg/m$^2$ by performing any one or more treatments selected from immersion to the ion-containing aqueous solution, spraying of the ion-containing aqueous solution, and cathode electrolytic treatment in the ion-containing aqueous solution is provided.

For the method for producing the surface-treated steel sheet of the present invention, it is preferable that:

1. the ion-containing aqueous solution in adjusting the surface is an alkaline aqueous solution containing one or more types of ions selected from a sodium ion, ammonium ion, and potassium ion, and
2. the pH of the ion-containing aqueous solution in adjusting the surface is 9 or more.

Further, according to the present invention, a method for producing the surface-treated steel sheet for forming a compound layer containing F and composed essentially of Zr at least on one surface of the steel sheet, including forming a layer where the Zr amount within the layer is 80 to 350 mg/m$^2$ by performing cathode electrolytic treatment to the steel sheet in the aqueous solution containing a Zr ion and F ion, and subsequently adjusting the surface to control the F amount in the layer to 0.5 to 10 mg/m$^2$ by performing spraying and/or immersion with water of 90° C. or more to the steel sheet is provided.

According to the present invention, when an organic resin layer is formed onto the surface, a surface-treated steel sheet having excellent adhesiveness to the organic resin layer and excellent corrosion resistance can be provided. Also, an organic resin coated metal container having excellent adhesiveness to an organic resin and resistance to fluorine elution, and a method for producing the surface-treated steel sheet can be provided. In particular, according to the present invention, a surface-treated steel sheet capable of preventing peeling of the organic resin layer even when processing and heat treatment are conducted after forming an organic resin layer on its surface, and suppressing elution of the metal material components constituting the container even when there is a crack in the organic resin layer and a metal surface is in the exposed state under a wet environment, an organic resin coated metal container using the surface-treated steel sheet, and a method for producing the surface-treated steel sheet are provided. Moreover, if the step of adjusting the surface with ion-containing aqueous solution according to the present invention is used, hot water conventionally used to clean the electrolytic chromic acid treated steel sheet can be changed to warm water or room-temperature water. Therefore, a method for producing the surface-treated steel sheet that has a shorter processing time compared to a case where only hot water washing is used and with excellent energy load characteristics can be provided.

DESCRIPTION OF THE PREFERRED EMBODIMENT

The surface-treated steel sheet of the present invention is a surface-treated steel sheet with a compound layer containing F and composed essentially of Zr at least on one surface of the steel sheet and it is important that the Zr amount within the layer is 80 to 350 mg/m$^2$ and the F amount is 0.5 to 10 mg/m$^2$.

It is important that the organic resin coated metal container of the present invention uses the surface-treated steel sheet.

Also, the method for producing the surface-treated steel sheet of the present invention is a method for producing the surface-treated steel sheet with a compound layer containing F and composed essentially of Zr formed at least on one surface of the steel sheet, and it is important that the method includes the steps of forming a layer where the Zr amount within the layer is 80 to 350 mg/m$^2$ by performing a cathode electrolytic treatment to the steel sheet in an aqueous solution containing a Zr ion and F ion, and subsequently adjusting the surface to control the F amount within the layer to 0. 5to 10 mg/m$^2$ by performing any one or more treatments selected from immersion to the ion-containing aqueous solution, spraying of the ion-containing aqueous solution, or cathode electrolytic treatment in an ion-containing aqueous solution.

Further, it is preferable that the ion-containing aqueous solution in the step of adjusting the surface is an alkaline aqueous solution containing one or more types of ions selected from a sodium ion, ammonium ion, and potassium ion, and the pH of the ion-containing aqueous solution in the step of adjusting the surface is 9 or more.

The method for producing the surface-treated steel sheet of the present invention is also a method for producing a surface-treated steel sheet for forming a compound layer containing F and composed essentially of Zr at least on one surface of the steel sheet. It is important that the method for producing the surface-treated steel sheet includes the steps of forming a layer to form a layer where the Zr amount within the layer is 80 to 350 mg/m$^2$ by performing a cathode electrolytic treatment to the steel sheet in an aqueous solution containing a Zr ion and F ion, and subsequently adjusting the surface to control the F amount within the layer to 0.5 to 10 mg/m$^2$ by performing spraying and/or immersion with water of 90° C. or more to the steel sheet.

The surface-treated steel sheet obtained according to the present invention is generally formed with an organic resin layer on top of a metal compound layer on the surface and used as a material for metal containers such as a can.

In the following, the surface-treated steel sheet, the organic resin coated container using the surface-treated steel sheet, and the method for producing the surface-treated steel sheet according to the present invention are described.

(Compound Layer Containing F and Composed Essentially of Zr)

It is considered that a compound layer containing F and composed essentially of Zr has a non-crystalline structure such as $ZrO_X(OH)_{Y-Z}F_Z$. By drying and baking, the layer is dehydrated and also F is eliminated, and it changes to an oxidized layer containing many crystalline components. As heating proceeds, the layer is considered to become a layer close to $ZrO_2$. However, excess heating that exceeds a heat history that a can material receives in general, leads to induce a crack in the layer due to a structural change and also the layer becomes more a ceramic-like layer and thus causes a decrease in processability and also in adhesiveness to a resin layer. Therefore, excess heating is not preferable. For these reasons, it is preferable that, basically, most part of the layer remains a structure such as $ZrO_X(OH)_{Y-Z}F_Z$ where least required F and OH basically remain.

Over a long period of time, we have investigated relationships of layer components such as the Zr amount and F amount with cross-cut resistance, and with adhesiveness to a coating resin. As a result, we have found that a layer with a large Zr amount and where its F amount is controlled to an appropriate range is necessary for these characteristics and thus came up with the present invention.

As for the plating amount of a metal compound formed at least on one surface of a steel sheet, the Zr amount of 80 mg/m$^2$ or more, and preferably 100 mg/m$^2$ or more is required. When the Zr amount is less than 80 mg/m$^2$, cross-cut resistance after organic resin coating and adhesiveness to an organic resin after retorting are insufficient. Also, when the Zr amount exceeds 350 mg/m$^2$, a layer is deposited excessively, and not only is it uneconomical, but also adhesiveness at processing gradually decreases, that it is not preferable.

Decrease in adhesiveness to a resin coating film during retorting is due to elution of layer components and generation of alkali by a cathode reaction, and it is considered to induce interfacial separation between the coated resin and metal layer. Therefore, it is important to suppress elution of F from the layer by eliminating F that exists excessively in the layer, and to secure coatability of the layer and not to allow cathode reaction as a reverse reaction to the anode reaction to occur easily by increasing the Zr amount. On the other hand, when the F amount is decreased excessively, structural change of the layer is induced, and leads to a decrease in cohesive force of the layer, which becomes the cause of a decrease in corrosion resistance during cross-cut testing with the resin coated metal sheet.

After various investigations, it was found that the required Zr amount in the surface-treated layer formed on a base material is at least 80 mg/m$^2$ or more, and more preferably, 100 mg/m$^2$ or more. When the Zr amount is less than 80 mg/m$^2$, cross-cut resistance after organic resin coating and organic resin adhesiveness after retorting become insufficient. Whereas, when the Zr amount exceeds 350 mg/m$^2$, a layer is deposited excessively, and not only is it uneconomical, but also adhesiveness at processing gradually decreases as the Zr amount increases, that it is not preferable to coat Zr over 350 g/m$^2$.

On the other hand, the F amount in the surface-treated layer needs to be controlled to 10 mg/m$^2$ or less. When the F amount exceeding 10 mg/m$^2$ exists excessively in the layer, a structural change may occur in a part of the layer structure by hydration during hot water sterilization treatment such as retorting, leading to a state where F as an excess anion existing in the layer can elute easily, and becomes the cause of a decrease in adhesiveness to the resin coating due to elution of the layer components. However, at the same time, excessive decrease of F should be avoided as described above. The F is an active component essential for the layer, and with the F amount of less than 0.5 mg/m$^2$, a structural change in the layer proceeds by hydration and causes cohesive force of the layer to decrease and the corrosion resistance decreases.

(Organic Resin Coated Metal Container)

In the present invention, as described in the following, forms of an organic resin coating and metal container are not particularly limited. However, a polyester resin coated seamless can manufactured by processing the precoated surface-treated steel sheet coated with a polyester resin is most preferably used in the light of adhesiveness to an organic resin coating film, resistance to elution of metal components constituting the container, and cross-cut resistance.

(Method for Producing a Surface-Treated Steel Sheet)

<Step of Forming a Layer>

First of all, the present invention is a method for producing a surface-treated steel sheet, and in a step of forming a layer, a compound layer containing F and composed essentially of Zr is formed at least on one surface of a steel sheet, so as to have a Zr amount of 80 to 350 mg/m$^2$, by performing a cathode electrolytic treatment to the steel sheet in an aqueous solution containing a Zr ion and F ion. The steel sheet after formation of a compound layer is washed with water after having squeezed out an electrolytic solution with rolls, and sent to the next step of adjusting the surface after having further squeezed out the wash water. Also, the steel sheet may be sent to the next step of adjusting the surface without washing with water after having squeezed out the electrolytic solution with rolls.

The electrolytic treatment liquid used in the step of forming a layer contains a Zr ion and F ion as essential components as mentioned above. Further, an electrolytic treatment liquid used in the step of forming a layer may contain components other than the Zr ion and F ion, such as a nitrate ion and ammonium ion used for pH adjustment, etc., and a Fe ion which is an eluted component from the base material.

A chemical agent to generate a Zr ion constituting the electrolytic treatment liquid is not particularly limited. For example, $K_2ZrF_6$, $(NH_4)_2ZrF_6$, $(NH_4)_2ZrO(CO_3)_2$, $H_2ZrF_6$, $ZrO(NO_3)_2$, $ZrO(CH_3COO)_2$, etc., can be used. In the present invention, the above mentioned chemical agents can be used singly or in a combination of two or more.

Further, when forming a Zr compound layer by a cathode electrolytic treatment, generally, a treatment solution containing a F ion in addition to the above Zr ion is preferably used as the electrolytic treatment liquid. By including a F ion in the electrolytic treatment liquid, the F ion acts as a complexing agent to enhance solubility of the Zr ion within the electrolytic treatment liquid. As a result, a Zr compound of a uniform film thickness can be deposited onto the base material. Accordingly, adhesiveness between the layer and organic resin layer can be improved. When F in the electrolytic treatment liquid is few, local depositing of Zr occurs and the layer becomes a state where thick-layer part and thin-layer part are mixed and uniformity of layer thickness becomes unsatisfactory. Consequently, the layer becomes a layer with unsatisfactory adhesiveness and corrosion resistance after processing. Therefore, in the step of forming a layer, it is important that the mole ratio of F/Zr (the mole ratio of F to Zr) in the layer be controlled so as to make the mole ratio of F/Zr to 0.6 or more.

For the chemical agent to generate a F ion in the electrolytic treatment liquid, for example, but not particularly limited to, ammonium zirconium fluoride, aluminum fluoride, titanium fluoride, sodium fluoride, ammonium fluoride, hydrofluoric acid, calcium fluoride, hexafluorosilicic acid, and sodium hexafluorosilicate, etc., can be used. In particular, an agent with high water solubility is preferable.

Further, to the electrolytic treatment liquid, in the light of improving conductivity in the treatment solution and adjusting pH of the treatment solution, an electrolyte such as a nitrate ion and ammonium ion or the like may be added to the extent of not hindering the formation of a Zr compound layer.

Additionally, in the electrolytic treatment liquid, one or more types of additives selected from such as an organic acid including citric acid, lactate, tartaric acid, glycolic acid or the like, and a polymer compound including polyacrylic acid, polyitaconic acid, phenol resin or the like may be added. In the present invention, by adding an additive such as an organic acid and phenol resin to the electrolytic treatment liquid, an additive such as organic acid and phenol resin can be included to a Zr compound layer formed. Consequently, flexibility is provided to the metal oxygen compound layer and adhesiveness to the organic resin layer can be further improved.

A current density for a case where a cathode electrolytic treatment is performed to the base material is preferably, but not particularly limited to, 1 to 30 A/dm$^2$.

Also, when performing a cathode electrolytic treatment to the base material, it is preferable to use the intermittent electrolysis method where a cycle of "energization and stop of energization" is repeated. When using the method, the total energization time for the base material (the total energization time when the cycle of "energization and stop of energization" is repeated for several times) is preferably 0.3 to 20 seconds.

Further, when performing a cathode electrolytic treatment to the base material, any sheet that does not dissolve into the electrolytic treatment liquid during the cathode electrolytic treatment can be used as a counter electrode sheet set to the base material. However, from the viewpoint of not dissolving easily to the electrolytic treatment liquid due to small oxygen overvoltage, a titanium sheet coated with iridium oxide is preferable.

<Step of Adjusting the Surface>

Next, in the step of adjusting the surface of the present invention, the surface-treated steel sheet obtained by forming a compound layer containing F and composed essentially of Zr in the step of forming a layer, is subjected to any one or more treatments selected from immersion to the ion-containing aqueous solution, spraying of the ion-containing aqueous solution, or cathode electrolytic treatment in the ion-containing aqueous solution, and the F amount within the layer is controlled to 0.5 to 10 mg/m$^2$. Then, the steel sheet is washed after having squeezed out the ion-containing aqueous solution from the steel sheet, washed with water, and then dried with hot air, etc., after further having squeezed out the wash water with the rolls.

Also, in the step of adjusting the surface in another embodiment of the present invention, the surface-treated steel sheet obtained by forming a compound layer containing F and composed essentially of Zr onto the base material in the step of forming a layer, is subjected to spraying and/or immersion treatment with water of 90° C. or more to control the F amount within the layer to 0.5 to 10 mg/m$^2$ by the treatment. Following this, the steel sheet is squeezed with rolls and then washed with water, and further squeezed with the rolls and dried. However, if the treatment is performed only with water at 90° C. or more, 3 seconds for surface adjustment is insufficient to make the F amount within the layer within the range of 0.5 to 1.0 mg/m$^2$ as described in a Comparative Example.

The step of adjusting the surface has the following two meanings. If the step of adjusting the surface is not followed, a container formed into a can after coating with resin causes structural change by hydration, though only gradually, in a part of the layer structure during a hot-water sterilization treatment process such as retorting. This leads to a state where excessive anions existing in the layer such as OH and F can elute easily into the content.

Thus, the first meaning is to reduce the excess anions in the layer in the step of adjusting the surface before resin coating is performed as the material for a can. In the step of adjusting the surface, including one or more types of ions selected from $Na^+$, $NH_4^+$, and $K^+$ to an aqueous solution is effective in efficiently eliminating F as these ions can easily bond with an anion, F.

Further, it is preferable to make the pH of the aqueous solution itself to alkaline in the step of adjusting the surface. By doing this, the F in the layer can easily exist in the form of free F ions and not in the form of complex ions and can be more efficiently eliminated. The pH of the ion-containing aqueous solution in the step of adjusting the surface is preferably 9 or more.

As above, with the step of adjusting the surface, the F amount can be controlled to 10 mg/m$^2$ or more.

Further, the second meaning is not to reduce F excessively. A reasonable amount of F is an active component necessary for the layer and when the F does not exist or exist in excessively small amount, a structural change of the layer by hydration proceeds easily and leads to a decrease in the cohesive force of the layer, and induces a decrease in corrosion resistance of the surface-treated layer. Therefore, control of the F amount to 0.5 mg/m$^2$ or more in the step of adjusting the surface is necessary.

Here, an influence of the Zr amount in the layer is further explained. In general, as the Zr amount increases, the amount of F contained in the layer also increases. Thus, the larger the Zr amount, the more F in the layer needs to be eliminated in the step of adjusting the surface, and it is preferable that the layer is processed in an aqueous solution where one or more types of ions selected from $Na^+$, $NH_4^+$, and $K^+$ are contained. Also, the total amount of $Na^+$, $NH_4^+$, and $K^+$ions contained in the aqueous solution is preferably 0.001 mol/L or more, more preferably 0.01 mol/L or more, and further preferably 0.02 mol/L or more. More, the pH of the aqueous solution is preferably 9 or more. On the other hand, in the light of a reaction speed and pH control of the ion-containing aqueous solution, the pH is preferably controlled to less than 14.

Furthermore, by performing cathode electrolytic treatment in the ion-containing aqueous solution, the effect obtained by eliminating F in the layer becomes greater than when only immersion is performed. From the viewpoint of efficiency, it is preferable to have a greater electric conductivity in the ion-containing aqueous solution used in a cathode electrolytic treatment, but preferably, the electric conductivity is at least 2 mS/cm or more. However, as described above, when the pH of the aqueous solution in the step of adjusting the surface is raised excessively high or when the length of energization time or current density in the cathode electrolytic treatment is increased too much, the layer becomes a layer that hardly contains F and the cohesive force of the layer decreases, thus attention should be paid to the control of the F amount.

An ion source used of the ion-containing aqueous solution used in the step of adjusting the surface is not particularly limited, but an ion source that indicates alkalinity, such as ammonia, ammonium zirconium carbonate, sodium hydroxide, sodium carbonate, sodium bicarbonate, sodium phosphate, dibasic sodium phosphate, potassium hydroxide, potassium carbonate, and sodium borate, etc., is preferable. Further, among these, the one with high water solubility is more preferable. Also, it is further preferable to provide a buffer action to the ion source by combining two or more types of alkali and alkalinity compound such as by adding sodium hydroxide to a sodium carbonate aqueous solution. As for a buffer solution, such as ammonia-ammonium chloride, sodium hydrogen carbonate-sodium carbonate, sodium hydrogen carbonate-sodium hydroxide, disodium hydrogen phosphate-sodium hydroxide, potassium chloride-sodium hydroxide, borate-potassium chloride-sodium hydroxide, and glycine-sodium hydroxide, etc., can be used.

Also, various types of surfactants and chelating agents can be added to the ion-containing aqueous solution as needed.

In the step of adjusting the surface, the temperature of the ion-containing aqueous solution is not particularly limited, but preferably 40° C. or more, and more preferably 60° C. or more. Also, the total treatment time for immersion, spraying, cathode electrolytic treatment with the ion-containing aqueous solution is preferably 0.5 to 5 seconds, and more preferably within 0.5 to 3 seconds.

Moreover, it is preferable to perform a cathode electrolytic treatment for the ion-containing aqueous solution in the step of adjusting the surface.

Furthermore, in the step of adjusting the surface, treatment with the ion-containing aqueous solution and immersion or spraying with warm water or hot water of around 40° C. to 95 ° C. may be both performed.

As above, according to the present invention, a method for producing the surface-treated sheet can be obtained.

As above, a surface-treated steel sheet obtained using the method for producing the surface-treated steel sheet obtained according to the present invention is, when an organic resin layer is formed on its surface, has excellent adhesiveness to the organic resin layer. Also, after formation of the organic resin layer, even when retort treatment is conducted after fabricating and filling up of the content are performed, the surface-treated steel sheet is capable of preventing peeling of the organic resin layer. Further, even when there is a crack in the organic resin layer and a metal surface is the exposed state under a wet environment, corrosion does not proceeds easily, and elution of components of the metal material constituting the container can be suppressed.

(Steel Sheet Base Material)

The base material is not particularly limited. For example, there can be used a hot-rolled steel sheet such as based on an aluminum-killed steel continuously cast material, a cold-rolled steel sheet obtained by cold-rolling the hot-rolled steel sheet, and a steel sheet that comprises the hot-rolled or cold-rolled steel sheet and a plated layer thereon including metal, such as Zn, Sn, Ni, Cu and Al. Among them, for the purpose of making the Zr amount larger, which is an object of the present invention, a steel sheet without a metal-plated layer, or even when a plated layer is prepared, a steel sheet with iron exposed in a part of its surface is most preferably used.

The thickness of the base material is not particularly limited and can be selected according to the purpose of use, but preferably 0.07 to 0.4 mm.

(Organic Resin Coating)

The resin constituting an organic resin layer coating the surface-treated steel sheet obtained according to the present invention is, though not particularly limited to, can be selected according to the purpose of use of the surface-treated steel sheet of the present invention (for example, for use as a can container to be filled up with a specific content). For example, a resin coating composed of various types of thermoplastic resins, or a coating layer composed of a thermosetting coating or thermoplastic coating may be used. As for a resin coating composed of a thermoplastic resin, an olefin resin film such as polyethylene, polypropylene, ethylene-propylene rubber, ethylene-vinyl acetate copolymer, ethylene-acrylic acid ester copolymer, and ionomer, etc., or a polyester film such as polyethylene terephthalate and polybutylene terephthalate, etc., or a polyamide film such as nylon 6, nylon 66, nylon 11, and nylon 12, etc., or an unstretched or biaxially stretched thermoplastic resin such as a polyvinylchloride film and polyvinylidene chloride film, etc., may be used. Particularly preferable among these are non-oriented polyethylene terephthalate obtained by copolymerization of isophthalic acid. Also, a resin for constituting such organic resin layer can be used singly or blended with a different resin.

When coating with a thermoplastic resin as an organic resin coating, a resin layer can be a single layer or a multi-layered resin layer formed such as by co-extrusion or the like. It is advantageous to use a multi-layered polyester resin layer, in that a polyester resin with a composition excellent in adhesiveness can be selected for the base layer, that is a surface-treated steel sheet side, and for the top layer, a polyester resin with a composition excellent in resistance to content, that is extraction resistance and non-adsorbability of flavor components, can be selected.

Examples of the multi-layered polyester resin layer are, when indicated as top layer/bottom layer, polyethylene terephthalate/polyethylene terephthalate-isophthalate, polyethylene terephthalate/polyethylene cyclohexylenedimethylene-terephtharate, polyethylene terephthalate containing a small amount of isophthalate-isophthalate/polyethylene terephthalate containing a large amount of isophthalate-isophthalate, polyethylene terephthalate-isophthalate/[mixture of polyethylene terephthalate-isophthalate and polybutylene terephthalate-adipate], etc., but of course, not limited to these examples. A thickness ratio of top layer: bottom layer is preferably within the range of 5:95 to 95:5.

For an organic resin layer, known compounding agents for a resin, for example, anti-blocking agent such as amorphous silica or the like, inorganic filler, various types of antistatic agents, lubricant, antioxidant, ultraviolet absorber, etc., can be mixed according to a known formula.

Of those above, tocopherol (vitamin E) is preferable. Tocopherol is known as an antioxidant for improving dent resistance by preventing decrease in the molar amount due to oxidative decomposition during heat treatment of a polyester resin. Specifically, when tocopherol is mixed to a polyester composition prepared by mixing the ethylene polymer to the polyester resin as a modified resin component, even when a crack is generated in the layer due to exposure to harsh conditions such as retorting sterilization or hot vendor, etc., not only resistance to dent is obtained, but also the progress of corrosion from the crack can be prevented and an effect of improvement in corrosion resistance can be obtained.

Tocopherol is preferably mixed in an amount of 0.05 to 3% by weight, and more particularly 0.1 to 2% by weight.

The thickness of the organic resin coating applied to a surface-treated steel sheet obtained according to the present invention is within the range of 3 to 50 μm in general and particularly, to be within the range of 5 to 40 μm is preferable for a thermoplastic resin coating. In the case of a coating film, the thickness after baking is preferably within the range of 1 to 50 μm and particularly, to be within the range of 3 to 30 μm is preferable. When the thickness is less than the above range, corrosion resistance becomes insufficient and when the thickness is more than the above range, a problem may arise in the point of processability.

Generation of an organic resin layer on a surface-treated steel sheet obtained according to the present invention can be performed by any means. For example, in the case of a thermoplastic resin coating, an extrusion coating method, a cast layer thermal adhesion method, and a biaxially-stretched layer thermal adhesion method or the like, can be used. When the extrusion coating method is used, an organic resin layer can be generated by coating the surface-treated metal material with a polyester resin in a molten state by extrusion and thermal bonding. In other words, after melt-kneading the polyester resin with an extruder, the polyester resin is extruded from a T-die in the form of a thin film, the extruded molten resin film is delivered through a pair of laminating rolls together with the surface-treated metal material to be pressed and combined together with cooling, and then immediately cooled. When coating with a multi-layered polyester resin layer by extrusion, an extruder for the top resin layer and an extruder for the bottom resin layer are used.

Resin flows from each extruder are merged in a multi-layer-extrusion-die and then extrusion coating is performed as in the case of a single-layer resin. Also, by delivering a surface-treated metal material between a pair of laminating rolls and by supplying a molten-resin web to both sides, a polyester resin coating layer can be formed on both surfaces of the substrate.

Specifically, manufacturing of an organic-resin-coated surface-treated steel sheet with an organic resin layer composed of a polyester resin with the extrusion coating method is performed as follows. A surface-treated steel sheet is heated in advance as needed with a heater and supplied to the nip position located between a pair of laminating rolls. Meanwhile, the polyester resin is extruded to a thin film through a die head of the extruder, supplied between the laminating roll and the surface-treated steel sheet and bonded with compression to the surface-treated steel sheet with the laminating rolls. The laminating rolls are kept at a constant temperature, and used to thermally bond the thin film composed of a thermoplastic resin such as polyester to the surface-treated steel sheet by thermal bonding and also cool the surface-treated steel sheet from both sides after thermal bonding to obtain an organic-resin coated surface-treated steel sheet. In general, the organic-resin coated surface-treated steel sheet is further subjected to an immediate cooling by leading to a cooling water bath or the like to avoid heat crystallization.

In this extrusion coating method, crystallinity of the polyester resin layer is suppressed to a low level, that is a difference of 0.05 g/cm$^3$ or less from the non-crystalline density, that satisfactory processability is assured for the subsequent can-making processing and lid processing, etc. Of course, the immediate cooling operation is not limited to the above examples, and the laminated sheet can also be immediately cooled by spraying cooling water to the created organic-resin-coated surface-treated steel sheet.

Thermal bonding of the polyester resin to the surface-treated steel sheet is conducted using the quantity of heat held by the molten-resin layer and the quantity of heat held by the surface-treated steel sheet. The heating temperature ($T_1$) for the surface-treated steel sheet is 90° C. to 290° C. in general, and in particular, a temperature of 100° C. to 280° C. is suitable, whereas, for the laminating rolls, a temperature within the range of 10° C. to 150° C. is suitable.

Further, the organic resin layer of the surface-treated steel sheet obtained according to the manufacturing method of the present invention can be also manufactured by thermally bonding a polyester resin film made in advance with the T-die method or inflation film-formation method to the surface-treated steel sheet. As for the film, an unstretched film prepared with the cast molding method in which the extruded film is immediately cooled can also be used. Also, a biaxially-stretched film obtained by biaxially stretching this film at a stretching temperature, either subsequently or simultaneously, and thermally fixing the film after stretching can also be used.

(Metal Container)

<Can>

A can body fabricated from a surface-treated steel sheet obtained according to the present invention, can be made with any can-making method as far as it is fabricated from the above-mentioned organic-resin-coated surface-treated steel sheet. The can body can be a three-piece can (welded can) with a joint on its side, a seamless can (two-piece can), or a can lid. However, as previously mentioned, from the viewpoint of utilizing a surface-treated steel sheet with a large Zr amount by taking into account adhesiveness to an organic resin, application to a seamless can is most preferable.

The seamless cans may be produced such that the organic resin layer is located inside the can, by any conventionally known means, such as drawing process, drawing/redrawing process, stretching process via drawing/redrawing, stretching/ironing process via drawing/redrawing, or drawing/ironing process.

Also, for the seamless cans produced through the above processes, which are produced using a highly sophisticated process, such as stretching process via drawing/redrawing and stretching/ironing process via drawing/redrawing, it is particularly preferable that the organic resin layer is the thermoplastic resin coating by the extrusion coating method.

In other words, such an organic-resin-coated surface-treated steel sheet is excellent in adhesiveness at processing, that a seamless can excellent in coating adhesiveness even when subjected to harsh processes and excellent in corrosion resistance can be provided.

<Lid>

A can lid fabricated from a surface-treated steel sheet obtained according to the present invention, can be made with any lid-making method conventionally known to the public as far as it is fabricated from the above-mentioned organic-resin-coated surface-treated steel sheet. The can lid can be a flat lid, an easy-open can lid of a stay-on-tab type, or an easy-open can lid of a full-open type.

The can lid in the present invention can be formed by using the organic-resin-coated surface-treated steel sheet of the present invention in various forms without restrictions.

EXAMPLES

Hereinafter, the present invention will be specifically described with reference to examples, but the present invention is not limited to these examples. A treating material, a degreasing agent, and an organic resin layer used in the examples are arbitrarily selected from those available on the market, and they are not intended to limit the method for producing the surface-treated steel sheet of the present invention.

Further, the method for producing a surface-treated sheet and the evaluation method of each characteristic were as follows.

<Step of Forming a Layer>

As for the base sheet, a low-carbon steel sheet having a thickness of 0.225 mm and a width of 200 mm was used. Then, the steel sheet was subjected to alkaline electrolytic degreasing as the pretreatment and then pickling was performed by sulfuric acid immersion. Next, the steel sheet was immersed into an electrolytic treatment liquid and subjected to a cathode electrolytic treatment to form a compound layer containing F and composed essentially of Zr to both steel sheet surfaces. The steel sheet was then squeezed with rolls, washed with water, and further the wash water was squeezed out.

As for the electrolytic treatment liquid, an aqueous solution, of a composition where the Zr concentration is 6000 ppm and the F concentration is 7000 ppm prepared by dissolving ammonium zirconium fluoride as a Zr compound was used.

pH of electrolytic treatment liquid: 3.0 (pH adjustment was performed with nitric acid and/or ammonia)

Temperature of electrolytic treatment liquid: 40° C.

Current density during cathode electrolytic treatment: 10 $A/dm^2$

Energization method during cathode electrolytic treatment: A cycle of "0.15-second energization and 0.1-second stop of energization" was performed for several times (hereafter called as "the number of cycles").

<Step of Adjusting the Surface>

The steel sheets obtained after following the step of forming a layer, were processed in an ion-containing aqueous solution for a predetermined time, then the steel sheets were squeezed with rolls, washed with water, further squeezed with rolls, and dried with hot air.

Among these, some steel sheets were further subjected to warm water washing by immersion or spraying after immersion with warm water of 40° C. or more after having processed with the ion-containing aqueous solution and then dried with hot air.

Further, for other steel sheets, treatment with the ion-containing aqueous solution was omitted and a process of warm water washing, where immersion or spraying after immersion with warm water of 90 to 95° C., was performed. Subsequently, the warm water was squeezed out from the steel sheet with rolls and then the steel sheet was dried with hot air.

<Measurement of the Zr Amount>

For the surface-treated sheet obtained in each example and comparative example, the Zr amount contained in the metal compound layer was measured using an X-ray fluorescence spectrometer (available from Rigaku Corporation, model number: ZSX100e).

<Measurement of the F Amount>

In a fluorescence X-ray analysis, there is a limit in microanalysis of the F amount in the light of quantitative accuracy. Particularly, it is difficult to directly quantify F from a surface-treated sheet where the F amount is 1.5 $mg/m^2$ or less. After various investigations, we have selected the following measurement method. That is, using a special cell which can be subjected to retort pressurization, retort treatment was performed for 30 minutes at 130° C. under a condition where a surface-treated sheet with a certain area is in contact with a certain amount of ultrapure water. The fluorine ions extracted to the ultrapure water by the treatment was measured with an ion chromatograph (available from Dionex, DX-320). From the obtained F concentration, the weight of F in the ultrapure water was determined and the value was converted into the weight of F per unit area of the surface-treated-sheet and the value was defined as the F amount within the layer.

<Evaluation of Adhesiveness for a Can (Inner-Bottom Part), Cross-Cut Resistance, and Resistance to F Elution>

1. Manufacturing of an Organic-Resin-Coated Surface-Treated Steel Sheet

To the obtained surface-treated steel sheet, a 19 μm-thick stretched film including polyethylene terephthalate/isophthalate copolymerized composition, wherein 11 mol. % of isophthalic acid component is contained, was bonded by thermocompression via laminating rolls to one surface of the metal sheet that becomes the inner can-surface, and a 13 μm-thick stretched film including polyethylene terephthalate/isophthalate copolymerized composition, where 12 mol. % of isophthalic acid component is contained, and colored to white by containing titanium oxide, to the other surface that becomes the outer can-surface. Then, the obtained steel sheet was immediately cooled with water to obtain an organic-resin-coated surface-treated steel sheet while paying attention to maintain a certain amount of alignment to the film. The manufactured organic-resin-coated surface-treated steel sheet was used in manufacture of a metal can except that a part thereof was used for cross-cut evaluation.

2. Evaluation of Cross-Cut Resistance

To the part of the produced organic-resin-coated surface-treated sheet that corresponds to the inner can-surface, a cross-cut scratch of 4 cm in length that reaches up to the base was made with a cutter. Then, the scratched steel sheet was immersed into a model liquid (an aqueous solution wherein the weight concentration is 1.5% for both sodium chloride and citric acid) for one week at 37° C. and the corrosion state was evaluated. Next, the test piece was taken out from the model liquid and the state of peeling in the organic resin layer at the cross-cut section and its surroundings, and the state of color changes due to generation of corrosion products were observed and evaluated by sight. For the surroundings of the cross-cut section, "C" is indicated for those with a color-change width or a maximum film peeling width of 2 mm or more in one side, "B" for those with 1 mm or more and less than 2 mm, and "A" for those with less than 1 mm.

3. Manufacturing of a Metal Can

To both surfaces of the obtained organic-resin-coated surface-treated sheet, a paraffin wax was applied by electrostatic oiling, punched out to a 143 mm-diameter disk shape, and a drawn cup having a diameter of 91 mm and a height of 36 mm was manufactured according to a conventional method. Following this, a simultaneous drawing and ironing process was repeated twice to fabricate a cup having a small diameter and tall height. The characteristics of the cup thus obtained were as follows.

Cup diameter 52.0 mm

Cup height 111.7 mm

Thickness decrease rate of can wall with respect to the original sheet 30%

After dome formation, the cup was subjected to heat treatment for 60 seconds at 220° C. to eliminate resin film distortion, which is then followed by a trimming process of the open end edge, printing to the curved surface, a process of neck-in to a diameter of 50.8 mm, and a flanging process to manufacture a 200 g seamless can.

4. Evaluation of Adhesiveness in Inner Can-Surface

Using a manufactured can, retort treatment was performed for 30 minutes at 125° C. after filling up with distilled water based on a usual method. Then, its content was removed after removing the lid from the canbody, and cut in half on the line of 45 degrees to the rolling direction of the surface-treated sheet. Next, the can cut in half was immersed to a liquid prepared by adding 0.02% by weight of surfactant to 1% by weight of sodium chloride aqueous solution for one hour. After the immersion, the can was cut further into half from the can bottom side on the line of 135 degrees to the rolling direction and adhesiveness was evaluated by observing the state of peeling in the cut surface of the inner can-surface bottom radius section which was cut last. "C" is indicated for those found with a peeling around the cut surface, "B" for those with slight peeling when the cut section was touched with a needle with a sharp end, and "A" for those where no peeling was found.

5. Evaluation of Resistance to F Elution

The manufactured can was filled with 183 g of ultrapure water and subjected to retort treatment for 30 minutes at 130° C. Then, measurement for fluorine ions extracted into the ultrapure water was performed with an ion chromatograph (available from Dionex, DX-320). When F is detected, "C" was indicated, and when F was at the detection limit (0.1 ppm) or less, "B" was indicated.

Example 1

In the step of forming a layer, cathode electrolytic treatment was performed for 7 cycles to the steel sheet surface and the electrolytic treatment liquid was squeezed out. Then, the steel sheet was washed with water at the room temperature and further, the wash water was squeezed out with rolls. Next, in the step of adjusting the surface, the steel sheet was immersed into a mixed aqueous solution at 40° C. for one second, wherein sodium carbonate and sodium bicarbonate were mixed, and the pH was adjusted to 9.5. Following this, the steel sheet was further immersed into hot water of 95° C. for one second, washed with water after the aqueous solution is squeezing out with rolls, and dried after further squeezing out the wash water with rolls to obtain a surface-treated steel sheet.

Next, the Zr amount and F amount of the sheet after the step of forming a layer but before the step of adjusting the surface, and the surface-treated steel sheet after the step of adjusting the surface were measured in accordance with the method described above. The results are shown in Table 1. Nevertheless, the Zr amount of the layer after the step of adjusting the surface was almost the same as the Zr amount after the step of forming a layer, thus it was omitted.

Using the produced organic-resin-coated surface-treated steel sheet and metal can, cross-cut resistance, adhesiveness at the inner can-bottom part, and resistance to F elution were evaluated. The results of the performance evaluation are shown in Table 1.

In Table 1 and in Table 2 described later, the ion-containing aqueous solution includes both cases where it was prepared by adding a chemical agent accordingly to obtain the target pH and where it was prepared while determining the concentration of the chemical agent in advance. Only for the latter case, the concentration of the chemical agent is indicated. Further, for the pH value, the one measured at 25° C. is used. More, as for Table 1 and Table 2, "-" mark is shown in the table for those cases where treatment with ion-containing aqueous solution was not performed, and where warm water washing with water at 40° C., or more is not performed.

Examples 2 to 22

As in Example 1, conditions and the plating amount (the Zr amount and F amount) in the step of forming a layer, conditions used in the step of adjusting the surface and the F amount of the layer after having gone through the step, and the results of the performance evaluation for the organic-resin-coated surface-treated sheet and metal can are shown in Table 1. However, in Examples 3 to 11, Example 21, and Example 22, warm water washing was performed by immersion for the first half of the treatment time shown in Table 1 and spraying for the second half. As for Examples 14 to 16, in the step of adjusting the surface, surface adjustment was performed, while using the steel sheet as the cathode, by repeating the cycle of "0.15-second energization and 0.1-second stop of energization" twice in the ion-containing aqueous solution at a current density of 10 A/dm$^2$.

TABLE 1

| | Step of forming a layer | | | Step of adjusting the surface | | | | | | | | Performance evaluation | | |
|---|---|---|---|---|---|---|---|---|---|---|---|---|---|---|
| | Number of cycles | Amount coated on surface-treated sheet Zr amount mg/m$^2$ | Amount coated on surface-treated sheet F amount mg/m$^2$ | Treatment with ion-containing aqueous solution Chemical agent | pH | Temp. ° C. | Time Second | Warm water washing treatment Temp. ° C. | Time Second | Amount coated on surface-treated sheet F amount mg/m$^2$ | Cross-cut resistance | Inner can-surface adhesiveness | Resistance to F elution |
| Example 1 | 7 | 94 | 12 | $Na_2CO_3$, $NaHCO_3$ | 9.5 | 40 | 1 | 95 | 1 | 4.2 | A | A | B |
| Example 2 | 6 | 80 | 10 | $Na_2CO_3$, $NaHCO_3$ | 10.2 | 40 | 1 | — | | 5.5 | B | B | B |
| Example 3 | 12 | 167 | 26 | $Na_2CO_3$, $NaHCO_3$ | 10.5 | 40 | 1 | 95 | 2 | 4.1 | A | A | B |
| Example 4 | 7 | 95 | 12 | $Na_2CO_3$, NaOH | 10.8 | 40 | 1 | 95 | 2 | 0.55 | B | A | B |
| Example 5 | 11 | 144 | 21 | $Na_2CO_3$, NaOH | 10.8 | 40 | 1.5 | 95 | 3 | 1.5 | A | A | B |
| Example 6 | 8 | 121 | 17 | $Na_2CO_3$, NaOH | 10.8 | 40 | 1 | 95 | 2 | 1.1 | A | A | B |
| Example 7 | 7 | 94 | 12 | $Na_2CO_3$, NaOH | 10.8 | 40 | 1 | 40 | 2 | 2.8 | A | A | B |
| Example 8 | 12 | 164 | 24 | $Na_2CO_3$, NaOH | 11.3 | 40 | 1 | 40 | 2 | 8.5 | A | A | B |
| Example 9 | 12 | 165 | 24 | $Na_2CO_3$, NaOH | 11.3 | 40 | 1 | 65 | 7 | 0.8 | A | A | B |
| Example 10 | 12 | 166 | 25 | $Na_2CO_3$, NaOH | 11.3 | 40 | 1 | 95 | 7 | 3.9 | A | A | B |
| Example 11 | 12 | 160 | 22 | | — | | | 90 | 4 | 9.8 | A | A | B |
| Example 12 | 14 | 216 | 33 | $Na_2CO_3$, 0.08 mol./lit. | 11.2 | 45 | 5 | — | | 1.7 | A | A | B |
| Example 13 | 24 | 326 | 52 | $Na_2CO_3$, 0.08 mol./lit. | 11.2 | 45 | 5 | — | | 4.2 | A | A | B |
| Example 14 | 8 | 104 | 14 | $Na_2CO_3$, 0.08 mol./lit. | 11.2 | 45 | 0.3 sec. by electrolysis | — | | 0.7 | B | A | B |
| Example 15 | 14 | 203 | 31 | $Na_2CO_3$, 0.08 mol./lit. | 11.2 | 45 | 0.3 sec. by electrolysis | — | | 1.2 | A | A | B |
| Example 16 | 24 | 345 | 55 | $Na_2CO_3$, 0.08 mol./lit. | 11.2 | 45 | 0.3 sec. by electrolysis | — | | 1.7 | A | A | B |
| Example 17 | 8 | 115 | 16 | $Na_2CO_3$, $HNO_3$ | 10.0 | 30 | 1 | — | | 5.3 | A | A | B |
| Example 18 | 12 | 168 | 25 | $Na_2CO_3$, $HNO_3$ | 10.0 | 30 | 2 | — | | 7.5 | A | A | B |
| Example 19 | 12 | 152 | 22 | $Na_2CO_3$, $HNO_3$ | 9.7 | 30 | 2 | — | | 8.2 | A | A | B |
| Example 20 | 12 | 110 | 15 | $NH_4OH$, $NH_4Cl$ | 9.2 | 60 | 2 | — | | 9.8 | A | A | B |
| Example 21 | 12 | 155 | 23 | NaOH, $Na_2HPO_4$ | 12 | 60 | 1 | 60 | 2 | 3.2 | A | A | B |
| Example 22 | 8 | 103 | 14 | NaOH 0.001 mol./lit. | 10.8 | 60 | 2 | 40 | 2 | 6.4 | A | A | B |

Comparative Examples 1 to 10

As in Example 1, conditions and the plating amount (the Zr amount and F amount) for the step of forming a layer, conditions used in the step of adjusting the surface and the F amount 670 of the layer after having gone through the step, and the results of the performance evaluation for the organic-resin-coated surface-treated sheet and metal can are shown in Table 2. However, in Comparative Examples 6 to 8 and Comparative Example 10, warm water washing was performed by immersion for the first half of the treatment time shown in Table 2 and spraying for the second half. As for Comparative Example 9, in the step of adjusting the surface, surface adjustment was 675 performed, while using the steel sheet as the cathode, by repeating the cycle of "0.15-second energization and 0.1-second stop of energization" for 4 times in the ion-containing aqueous solution at a current density of 10 A/dm$^2$.

TABLE 2

| | Step of forming a layer | | | Step of adjusting the surface | | | | | | | Performance evaluation | | |
|---|---|---|---|---|---|---|---|---|---|---|---|---|---|
| | Number of cycles | Amount coated on surface-treated sheet Zr amount mg/m$^2$ | Amount coated on surface-treated sheet F amount mg/m$^2$ | Treatment with ion-containing aqueous solution Chemical agent | pH | Temp. ° C. | Time Second | Warm water washing treatment Temp. ° C. | Time Second | Amount coated on surface-F amount mg/m$^2$ | Cross-cut resistance | Inner can-surface adhesiveness | Resistance to F elution |
| Comparative Example 1 | 2 | 43 | 3.1 | | | — | | | — | 3.1 | C | C | B |
| Comparative Example 2 | 4 | 69 | 9 | | | — | | | — | 9 | C | C | B |
| Comparative Example 3 | 8 | 110 | 15 | | | — | | | — | 15 | B | C | C |
| Comparative Example 4 | 14 | 194 | 29 | | | — | | | — | 29 | B | C | C |
| Comparative Example 5 | 24 | 331 | 37 | | | — | | | — | 37 | B | C | C |
| Comparative Example 6 | 12 | 160 | 22 | | | — | | 90 | 1 | 17 | B | C | C |
| Comparative Example 7 | 12 | 160 | 22 | | | — | | 90 | 2 | 14 | B | B | C |
| Comparative Example 8 | 12 | 160 | 22 | | | — | | 90 | 3 | 12 | B | B | C |
| Comparative Example 9 | 8 | 104 | 14 | $Na_2CO_3$, 0.08 mol./lit. | 11 | 45 | 0.6 sec. by electrolysis | — | — | 0.41 | C | B | B |
| Comparative Example 10 | 8 | 105 | 14 | NaOH | 13.5 | 65 | 2 | 95 | 2 | 0.08 | C | B | B |

As shown in Table 1, by making the Zr amount within the layer 80 to 350 mg/m$^2$ in the step of forming a layer, and by treating the steel sheet after the step of forming a layer in the ion-containing aqueous solution or hot water of 90° C. for a predetermined time in the step of adjusting the surface, a steel sheet with the F amount in the layer of 0.5 mg/m$^2$ to 10 mg/m$^2$ was manufactured. In Examples 1 to 22, not only the obtained organic-resin-coated metal sheet was excellent in cross-cut resistance, but also adhesiveness of the inner metal-can surface, resistance to F elution, and adhesiveness of the organic resin layer were excellent. Further, even after a fabricating process and retort treatment, or even when there is a crack in the resin layer, the organic resin layer exhibited excellent adhesiveness, thus it was confirmed that the container was excellent in maintaining the content quality.

On the other hand, as shown in Table 2, after having gone through the step of forming a layer, the cross-cut resistance of the organic-resin-coated metal sheet was unsatisfactory in Comparative Examples 1 and 2 where the Zr amount was less than 80 mg/m$^2$. As for the can performance, although the can had resistance to F elution, it was confirmed that adhesiveness of the inner surface was insufficient. Though not shown in the examples, under a condition where the Zr amount was small, it was confirmed that the above performance does not improve even when the step of adjusting the surface is followed. Meanwhile, in Comparative Examples 3 to 5, where the Zr amount was 80 mg/m$^2$ or more and where the step of adjusting the surface was not followed, the cross-cut resistance of the organic-resin-coated metal sheet improved but resistance to F elution decreased. Also, improvement was not confirmed even in Comparative Example 6, where the step of adjusting the surface was performed for one second with hot water of 90° C. Further, in Comparative Examples 7 and 8, where the step of adjusting the surface was performed for 2 to 3 seconds in hot water of 90° C., adhesiveness of the inner can-surface improved but improvement for F elution was unsatisfactory. In contrast, in Comparative Examples 9 and 10, where electrolytic treatment was excessively performed in the ion-containing aqueous solution in the step of adjusting the surface or where excess treatment was performed using high-concentration alkali, the F amount within the layer became less than 0.5 mg/m$^2$. Accordingly, it was confirmed that, although adhesiveness of the inner can-surface and resistance to F elution were improved, cross-cut resistance was reduced.

Further, although the F amount within the layer is about 0.4 mg/m$^2$ in the electrolytic chromic acid treated steel sheet, the F amount within the layer in each example was 0.5 mg/m$^2$ or more even after the step of adjusting the surface. Accordingly, as for the surface-treated steel sheet, it has become apparent that in the case of a steel sheet with a surface-treated layer composed of a compound composed essentially of Zr, the F amount needs to be larger than that in the electrolytic chromic acid treated steel sheet.

What is claimed is:

1. A method for producing a surface-treated steel sheet having a compound layer containing fluorine and zirconium at least on one surface of a steel sheet, the method comprising:

forming a layer wherein a zirconium amount within the layer is 80 to 350 mg/m$^2$ by performing a cathode electrolytic treatment to the steel sheet in an aqueous solution containing a zirconium ion and fluorine ion; and adjusting a surface to control a fluorine amount within the layer to 0.5 to 10 mg/m$^2$ by performing any one or more treatments selected from immersion to an ion-containing aqueous solution for 0.5 to 5 seconds, spraying of the ion-containing aqueous solution for 0.5 to 5 seconds, and cathode electrolytic treatment in the ion-containing aqueous solution for 0.5 to 5 seconds, wherein the ion-containing aqueous solution is at least one selected from the group consisting of a solution comprising $Na_2CO_3$ and NaOH, a solution comprising $Na_2CO_3$ and $HNO_3$, a solution comprising $NH_4OH$ and $NH_4Cl$, and a solution comprising NaOH and $Na_2HPO_4$.

2. The method for producing a surface-treated steel sheet according to claim 1, wherein a pH of the ion-containing aqueous solution in adjusting the surface is 9 or more.

3. The method for producing a surface-treated steel sheet according to claim 1, further comprising performing spraying and/or immersion with warm water or hot water of 40° C. to 95° C. to the steel sheet after the treatments selected from immersion to the ion-containing aqueous solution, spraying of the ion-containing aqueous solution, and cathode electrolytic treatment in the ion-containing aqueous solution.

4. The method for producing a surface-treated steel sheet according to claim 1, the treatments selected from immersion to the ion-containing aqueous solution, spraying of the ion-containing aqueous solution, and cathode electrolytic treatment in the ion-containing aqueous solution are performed at a temperature of 40° C. to 60° C.

5. The method for producing a surface-treated steel sheet according to claim 1, the treatments selected from immersion to the ion-containing aqueous solution, spraying of the ion-containing aqueous solution, and cathode electrolytic treatment in the ion-containing aqueous solution are performed for 0.5 to 3 seconds.

6. The method for producing a surface-treated steel sheet according to claim 1, wherein the zirconium amount of the compound layer containing fluorine and zirconium is 94 to 350 $mg/m^2$.

7. The method for producing a surface-treated steel sheet according to claim 1, further comprising forming an organic resin layer on the compound layer of the surface-treated steel sheet.

* * * * *